US008214942B2

(12) United States Patent
Yang et al.

(10) Patent No.: US 8,214,942 B2
(45) Date of Patent: Jul. 10, 2012

(54) REMOVABLE POP-UP DRAIN CONTROL WITH CATCH BASKET

(75) Inventors: Stewart Lee Yang, Kohler, WI (US); Ryan Frederick Leichty, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 684 days.

(21) Appl. No.: 12/185,609

(22) Filed: Aug. 4, 2008

(65) Prior Publication Data

US 2010/0024108 A1 Feb. 4, 2010

(51) Int. Cl.
*E03C 1/232* (2006.01)

(52) U.S. Cl. ..... 4/685; 4/690

(58) Field of Classification Search ..... 4/689–692, 4/684–685, 287

See application file for complete search history.

(56) References Cited

U.S. PATENT DOCUMENTS

| | | | | |
|---|---|---|---|---|
| 1,720,149 | A | 6/1928 | Rom | |
| 2,021,410 | A | 3/1935 | Foose | |
| 3,220,695 | A | 10/1961 | Downey et al. | |
| 3,366,980 | A | 4/1965 | Petursson et al. | |
| 3,428,295 | A | 8/1966 | Downey et al. | |
| 3,333,815 | A * | 8/1967 | Jones et al. | 251/263 |
| 3,839,744 | A | 10/1974 | Ziegelmeyer et al. | |
| 3,995,333 | A | 12/1976 | Stephens | |
| 4,103,372 | A | 8/1978 | Cuschera | |
| 4,144,599 | A | 3/1979 | Cuschera | |
| 4,188,676 | A | 2/1980 | Tolnai et al. | |
| 4,276,662 | A * | 7/1981 | Young | 4/295 |
| 4,339,832 | A | 7/1982 | Cuschera | |
| 4,369,531 | A * | 1/1983 | Swanson | 4/295 |
| 4,412,361 | A | 11/1983 | Cuschera | |
| 4,597,112 | A * | 7/1986 | Cuschera | 4/287 |
| 4,720,877 | A * | 1/1988 | Watts | 4/286 |
| 4,764,993 | A | 8/1988 | Oropallo | |
| 4,860,390 | A * | 8/1989 | Ohta | 4/295 |
| 5,918,993 | A | 7/1999 | Koyama | |

(Continued)

FOREIGN PATENT DOCUMENTS

GB 1214065 12/1970

OTHER PUBLICATIONS

Seven pages of a PCT search report of PCT/US2009/004375 dated Dec. 15, 2009 in a corresponding PCT application.

*Primary Examiner* — William Gilbert
*Assistant Examiner* — Gisele Ford
(74) *Attorney, Agent, or Firm* — Foley & Lardner LLP

(57) ABSTRACT

A drain control assembly has a pop-up stopper controlled by a cammed actuating mechanism allowing the stopper to alternately seal and unseat from the drain opening by repetitively pressing down on the stopper. The seal seats against the structure housing the drain, such as a tub or sink basin and the like, so that a clean look and positive seal can be achieved. The assembly has integral catch basket that serves to both retain items fallen into the drain and removably mount the assembly to a support beneath the drain opening such that the assembly is firmed secured in place for controlling flow through the drain, but also can be dislodged so that the entire assembly can be removed and items in the catch basket can be retrieved. The assembly can then be reinstalled by simply inserting it down into the drain. A method of use is also disclosed.

20 Claims, 5 Drawing Sheets

U.S. PATENT DOCUMENTS 5,996,143 A * 12/1999 Lordahl et al. ..... 4/689
6,067,669 A * 5/2000 Peterson et al. ..... 4/287
6,163,896 A 12/2000 Lee
6,195,819 B1 * 3/2001 Wang ..... 4/689
6,219,861 B1 4/2001 Chen
6,276,000 B1 8/2001 Saman et al.
6,442,770 B1 9/2002 Lin
6,553,583 B1 4/2003 Pan
6,880,179 B2 4/2005 Wang
7,013,500 B1 * 3/2006 Lin ..... 4/287
2004/0073992 A1 * 4/2004 Saman et al. ..... 4/287
2008/0178382 A1 7/2008 Pinette et al.

* cited by examiner

FIG. 1
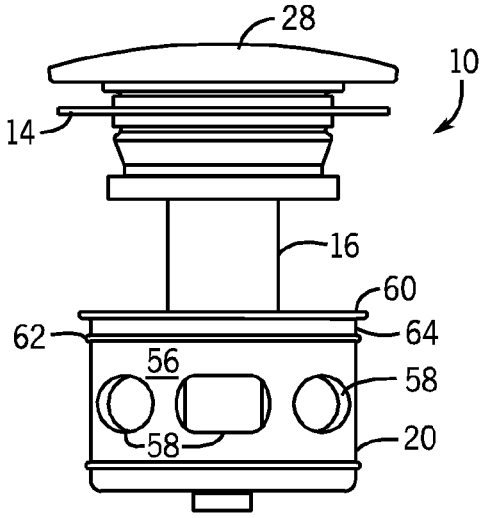
FIG. 2
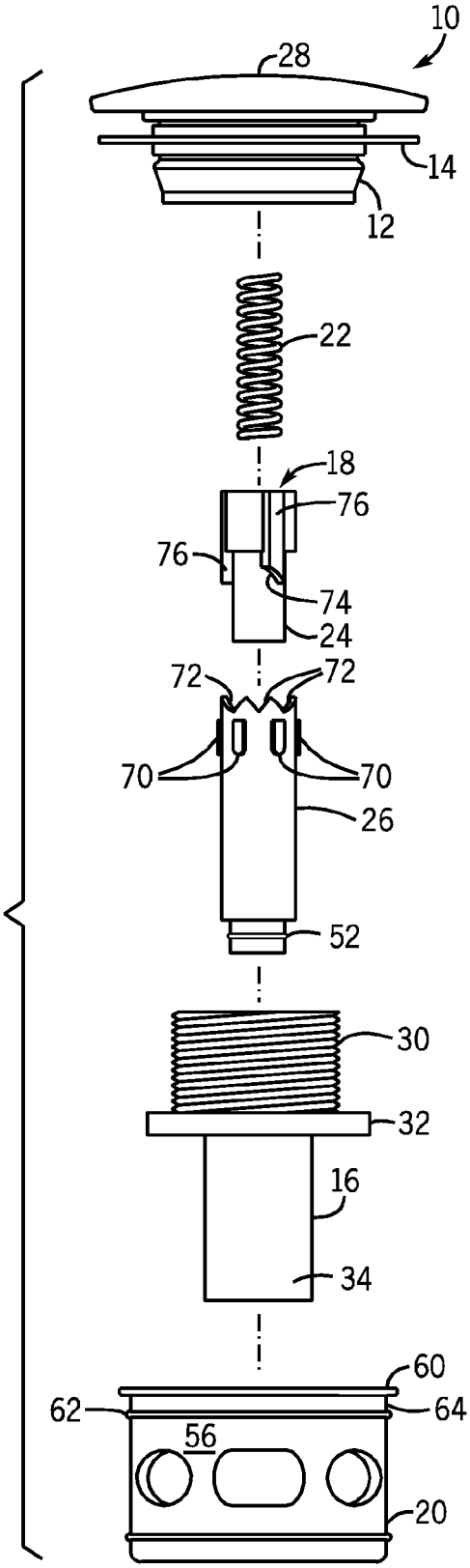
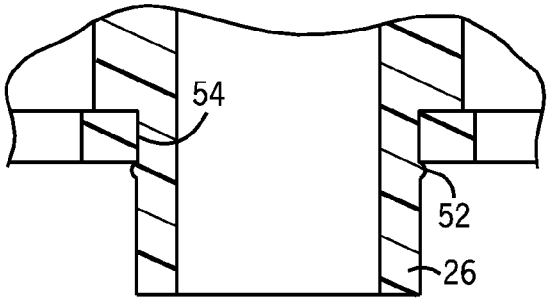
FIG. 5

78
76
24
40
72
70
16
26
38
36
74

76
24
74
72
36
70
16
40
26
78
38

24
76
74
72
78
70
40
36
16
26
38

76
78
72
40
70
36
16
26
24
38
74

76
24
78
72
40
70
36
26
38
74
16

REMOVABLE POP-UP DRAIN CONTROL WITH CATCH BASKET

CROSS-REFERENCE TO RELATED APPLICATIONS

Not applicable.

FEDERALLY SPONSORED RESEARCH/DEVELOPMENT STATEMENT

Not applicable.

BACKGROUND OF THE INVENTION

The present invention relates to plumbing fixtures, and more particularly to drain assemblies used to control the flow of fluid through a drain opening of a basin, such as a sink or bath tub.

There a variety of mechanism for controlling drain passages in plumbing fixtures, for example, simple stops and plugs, drain plugs linked to a pull-up lever, and pop-up style drain plugs. Pop-up drain plugs are advantageous because the mechanism for opening and closing the drain is contained in a compact package set within or beneath the drain, without linkages, levers or other components that need to be concealed and routed through walls, underspaces and the like. Pop-up drain plugs are also advantageous because the push-button type movement required by the user for actuation is simple and intuitive. The user need to merely press down on the drain plug, such as by stepping on it or using one's hand, to alternately toggle between open and closed positions. Another advantage of pop-up drain plugs is that they typically can be installed from above the basin, rather than the often cramped, dark space beneath the basin.

An example of a conventional pop-up drain plug assembly is provided in U.S. Pat. No. 3,333,815. There a housing is threaded into the drain opening of the basin such that an enlarged flange protrudes above the drain opening. A push button above the drain opening has a seal that seats against the flange to close off flow through the drain. The push button is mounted to a spring-load cam arrangement that bolts to the housing and allows the seal to toggle between seated and unseated positions.

While the disclosed drain plug assembly provides the aforementioned advantages typical of such pop-up assemblies, it requires a large, protruding flange for the sealing surface, which can diminish the aesthetic appearance of the fixture. Also, the disclosed drain plug can allow objects that inadvertently pass through the drain opening to continue on to the drain plumbing, possibly irretrievably.

U.S. Pat. No. 6,880,179 addresses the latter problem by incorporating a strainer component that extends across the drain opening beneath the operating components of the assembly. The strainer thus can collect items which passed through the drain opening and are larger than the strainer openings. However, the user must reach down into the strainer passed the seal in order to retrieve the collected items. Moreover, the strainer has an enlarged flange against which the seal seats such that the aforementioned aesthetic problem remains.

U.S. Pat. No. 6,067,669 discloses a drain plug assembly that provides improved access to the contents of the strainer by permitting the operating components to be disassembled so that the strainer can be removed from the drain. However, the disclosed assembly is not of the pop-up type, and as mentioned, removal of the strainer requires disassembly and subsequent reassembly to return it to operable condition.

BRIEF SUMMARY OF THE INVENTION

The present invention provides a pop-up drain control with an integral catch basket that serves to both retain items fallen into the drain and removably mount the assembly to a support beneath the drain opening such that the assembly is firmly secured in place for controlling flow through the drain, but also can be dislodged so that the entire assembly can be removed and items in the catch basket can be retrieved. The assembly can then be reinstalled by simply inserting it back down into the drain.

Specifically, a pop-up drain control assembly has a stopper with an annular seal. A posts mounts the stopper at one end and defines an annular cavity extending along an axis passing through the drain opening. A spring-biased actuating assembly is disposed within the annular cavity for moving the stopper along the axis and engaging the seal with the drain housing about the drain opening. A catch basket is mounted to the actuating mechanism for relative movement of the stopper. The catch basket is sized and configured to removably mount the drain control assembly within the drain opening.

The catch basket can be cup-shaped with a bottom and a cylindrical side wall. The bottom and/or the side wall can have one or more openings sized smaller than the drain opening for allowing draining. The bottom also has an opening for receiving a member of the actuating assembly in a snap fit. In this configuration, the side wall of the catch basket can fit into an opening in a supporting wall beneath the drain opening. The catch basket can engage the wall in a threaded, friction fit, snap fit or other such connection that allows the drain control assembly to remain securely in place within the drain opening during normal use and activation of the stopper, but also permit the assembly to be pulled from the drain opening for retrieving items caught within the catch basket.

The mechanism for actuating the stopper includes a spring, a cam insert and a support stem all movable disposed axially within the post cavity, which has a splined internal surface having axially extending cammed splines between recesses and stops extending radially inward of the recesses. The spring is captured between the stopper and the cam insert. The cam insert has one or more radial projections, each defining a cam surface. The support stem, which can be linked directly to the catch basket via a snap fit, has one or more cam surfaces for engagement with the cam surface(s) of the cam insert. The support stem also has one or more radial projections. The recess(es) are sized to receive the radial projections of the cam insert and the support stem, and the radial projections are sized to engage the cam surfaces of the support stem during certain axial positions of the assembly and the cams surfaces of the splines and the stops at other times.

The stopper is movable along the axis to seat and unseat the seal against the drain housing, such as the surface of the basin in a sink or tub, and thereby open or seal off the drain opening. The actuating mechanism is actuated by depressing the stopper toward the catch basket, which is engaged to the support surface. The stopper is returned to unseat the seal by depressing the stopper again.

Another aspect of the invention is a method of selectively sealing a drain opening and retrieving an item fallen into the drain opening. Thus, a drain control assembly as described above is provided within the drain opening such that the catch basket is removably engaged with a support surface below the drain opening to hold it in place to allow stopper to seat or unseat the seal during normal use. If an item has fallen into the drain opening, the entire assembly can be removed by simply pulling upwardly on the stopper to disengage the catch basket from the support surface. Once disengaged, the assembly is pulled clear of the drain opening so that the item within the catch basket can be accessed and retrieved. The assembly is reset by placing it back into the drain opening and engaging the catch basket with the support surface.

The present invention thus provides an improved pop-up or push-button style drain control assembly having a clean aesthetic appearance without a sealing flange protruding above the basin, that is simple to install and operate, and that provides easy access to the contents of the catch basket without requiring disassembly.

The foregoing and still other advantages of the invention will appear from the following description. In that description reference is made to the accompanying drawings which form a part hereof and in which there is shown by way of illustration a preferred embodiment of the invention. That embodiment does not represent the full scope of the invention. Rather, the claims should be looked to in order to judge the full scope of the invention.

BRIEF DESCRIPTION OF THE DRAWINGS

FIG. 1 is an elevational view of the drain assembly according to the present invention;

FIG. 2 is an exploded assembly view thereof;

FIG. 5 is an enlarged sectional view taken along the arc 5-5 of FIG. 3 showing the connection of a catch basket;

DETAILED DESCRIPTION OF THE PREFERRED EMBODIMENT(S)

Figures 3, 6:
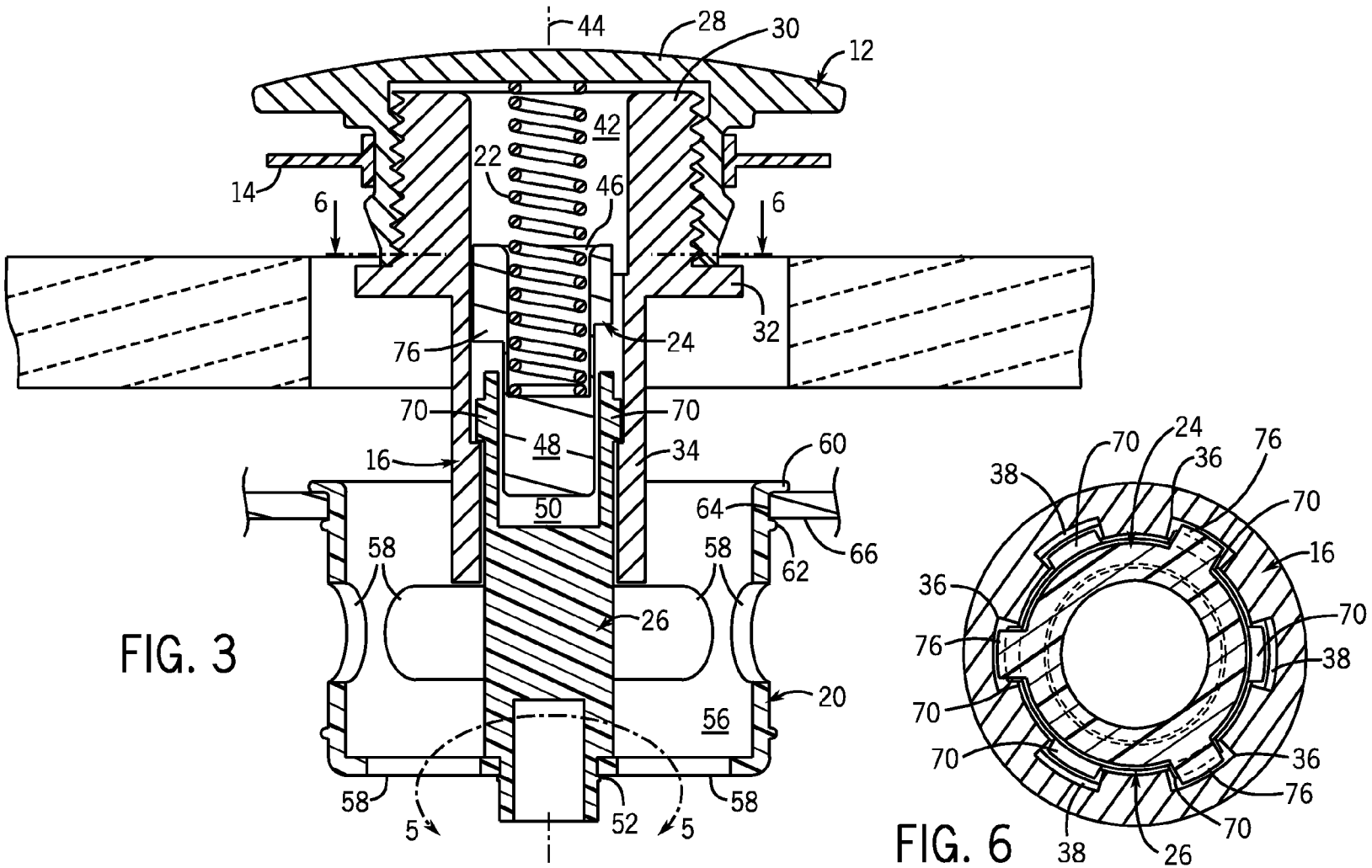
FIG. 3 is an enlarged sectional view thereof situated in a drain of bath tub basin in an open position allowing the basin to be drained.
FIG. 6 is a sectional view taken along line 6-6 of FIG. 3 showing the relative orientation of actuating assembly components relative to an internally splined mounting post when in the open position of FIG. 3.

Referring to FIGS. 1 and 2, a pop-up drain control assembly 10 includes a stopper 12, an annular seal 14, an annular mounting post 16, an actuating assembly 18 and a catch basket 20. The actuating assembly 18 in turn includes a spring 22, a cam insert 24 and a support stem 26.

More specifically, the stopper 12 has a large head 213 that conceals the drain opening from above and provides a large surface for the user to press against when operating the assembly 10 by hand or foot. The stopper 12 narrows beneath the large head and defines a shallow groove in which the seal 14 is disposed. The groove and seal 14 are located and sized to contact, and thus directly seal against, the structure defining the drain opening, such as a sink or tub basin, rather than sealing against another component of the drain assembly. This eliminates unsightly flanges and the like from being visible by the user. The stopper 12 is open and internally threaded at its bottom end so that it can be threaded onto the upper threaded end 30 of the mounting post 16.

Figure 9:
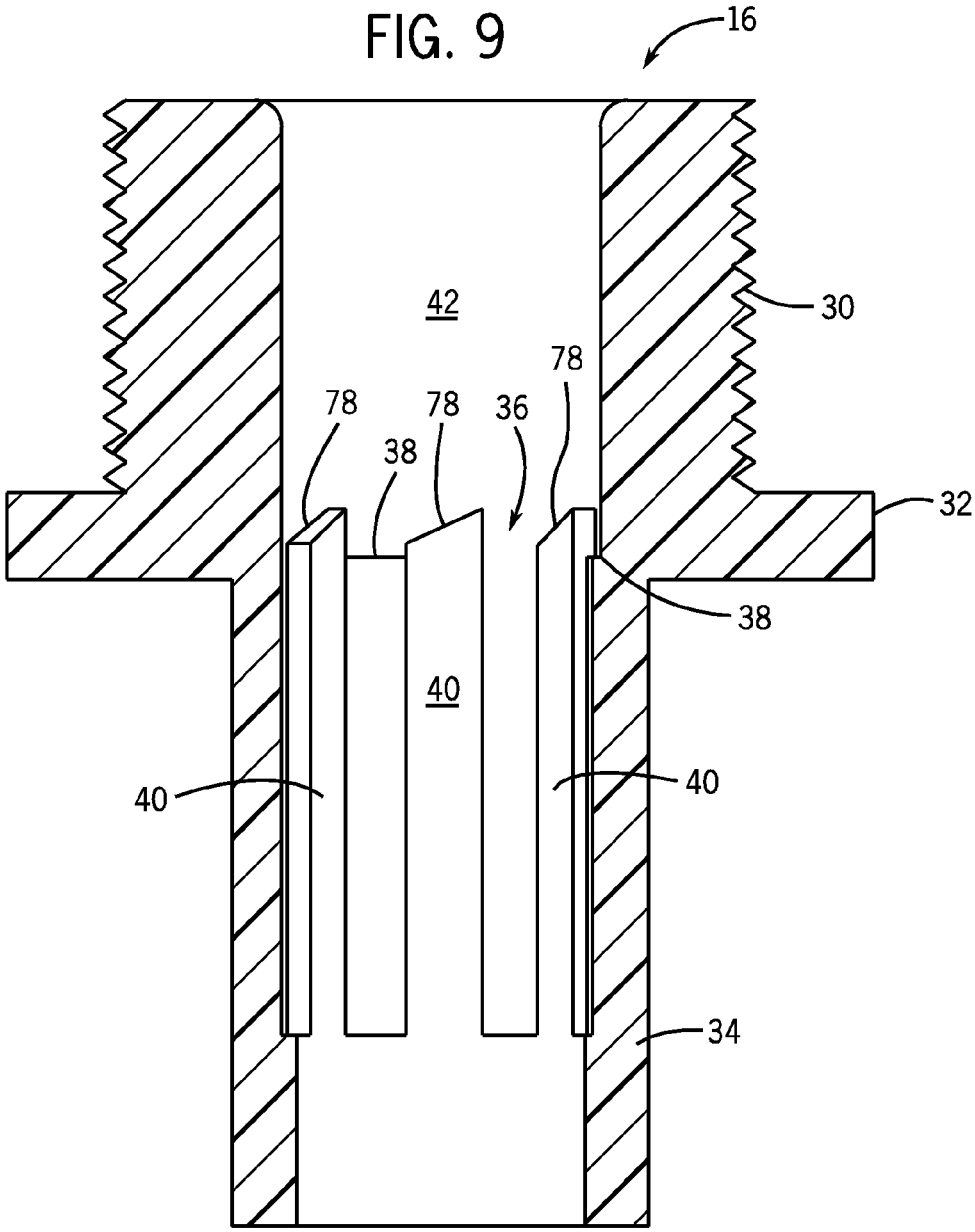
FIG. 9 is a sectional view showing the internal features of the mounting post.

As shown in FIG. 9, the mounting post 16 is an annular member with a central flange 32 and a narrowed cylindrical portion 34. The mounting post 16 is hollow and open-ended with an internal surface defining recesses 36 and stops 38 on each side of six splines 40 extending along the narrow portion 34. The mounting post 16 defines an internal cavity 42, which the recesses 36 open to, extending along an axis 44 (see FIG. 3) that passes through the drain opening, when the assembly 10 is installed therein. The internal cavity 42 of the mounting post 16 contains the components of the actuating assembly 18, including the spring 22, cam insert 24 and support stem 26.

The spring 22 is captured between the stopper 12 and the cam insert 24, and nested within a pocket 46 at one end of the cam insert 24. The cam insert 24 in turn is disposed between the spring 22 and the support stem 26, with its narrowed end 48 nested into a pocket 50 of the support stem 26. The support stem 26 is disposed between the cam insert 24 and the catch basket 20. As shown in FIG. 5, the distal end of the support stem 26 is narrowed and has a circumferential projection 52 that fits through an opening 54 in the bottom of the catch basket 20 in a snap-fit connection.

The cup-shaped catch basket 20 has a cylindrical side wall 56 extending in a generally axial direction from the bottom. Although the bottom and side wall are shown and described herein as being generally circular and cylindrical, respectively, the bottom could be of other suitable geometry, such as multi-sided, and there could then be multiple side walls. In any event, the bottom and side wall have openings 58 therethrough to allow flow to pass therethrough without impeding normal draining through the drain opening. The side wall also has an upper radially extending flange 60 and a circumferential projection 62 between which a groove 64 is formed for connecting the catch basket 20, and thereby the assembly 10, to a support member 66 located beneath the drain opening (see FIG. 3). The connection of the catch basket 20 to the support member 66 can be achieved in any suitable means;, including threading, snap-fit, friction fit and other mechanical connections sufficient to secure the assembly 10 securely in place so that the assembly can be operated to seat and unseat the seal 14, but also be able to disengage the catch basket 20, and thereby the entire assembly 10, from the support member 66. Application of downward forces (that is in the direction from the stopper 12 to the catch basket 20) works to seat the upper flange 60 of the catch basket 20 against the support member 66, and thus ensure that the assembly 10 is secured in place. Since only downward forces are required to operate the stopper 12, a secure connection can be maintained during use. The projection 62 extends radially to a lesser extent than the upper flange 60, such that it is readily disengagable from the support member 60 by the application of upward forces. Therefore, the catch basket 20, and thereby the entire assembly 10, can be readily disengaged from the support member 66 by simply pulling the up on the stopper 12, possibly also slightly to one side. In this way, the catch basket 20 is configured to securely mount the assembly 10 at the drain opening, while permitting the assembly 10 to be removed easily.

The components and operation of the actuating assembly 18 will now be described in greater detail. As shown in FIG. 2, the upper end of the support stem 26 has a number of radial projections 70 and angled teeth-like cam surfaces 72 formed in the upper edge. The cam surfaces 72 mate with angled cam surfaces 74 at the bottom edges of radial projections 76 of the cam insert 24. The cam surfaces 72 of the cam insert 24 also mate with cam surfaces 78 at the upper ends of the splines 40, which are radially outside of the cam surfaces 72 of the support stem 26. In the illustrated embodiment, there are six angularly spaced radial projections 70 extending outward from the support stem 26 and three angular spaced radial projections 76 extending outward from the cam insert 24. However, the quantity and spacing of these projections could vary from that shown. The spring 22 biases the cam insert 24 toward, and the mounting post 16 and stopper away from, the support stem 26. Under the force of the spring 22, the cam surfaces 74 of the cam insert 24 engage the cam surfaces 72 of the support stem 26, the cam surfaces 78 of the splines 40 or the stops 38, depending upon the position of the drain assembly 10, as described below.

Figures 8A, 8B, 8C, 8D, 8E:
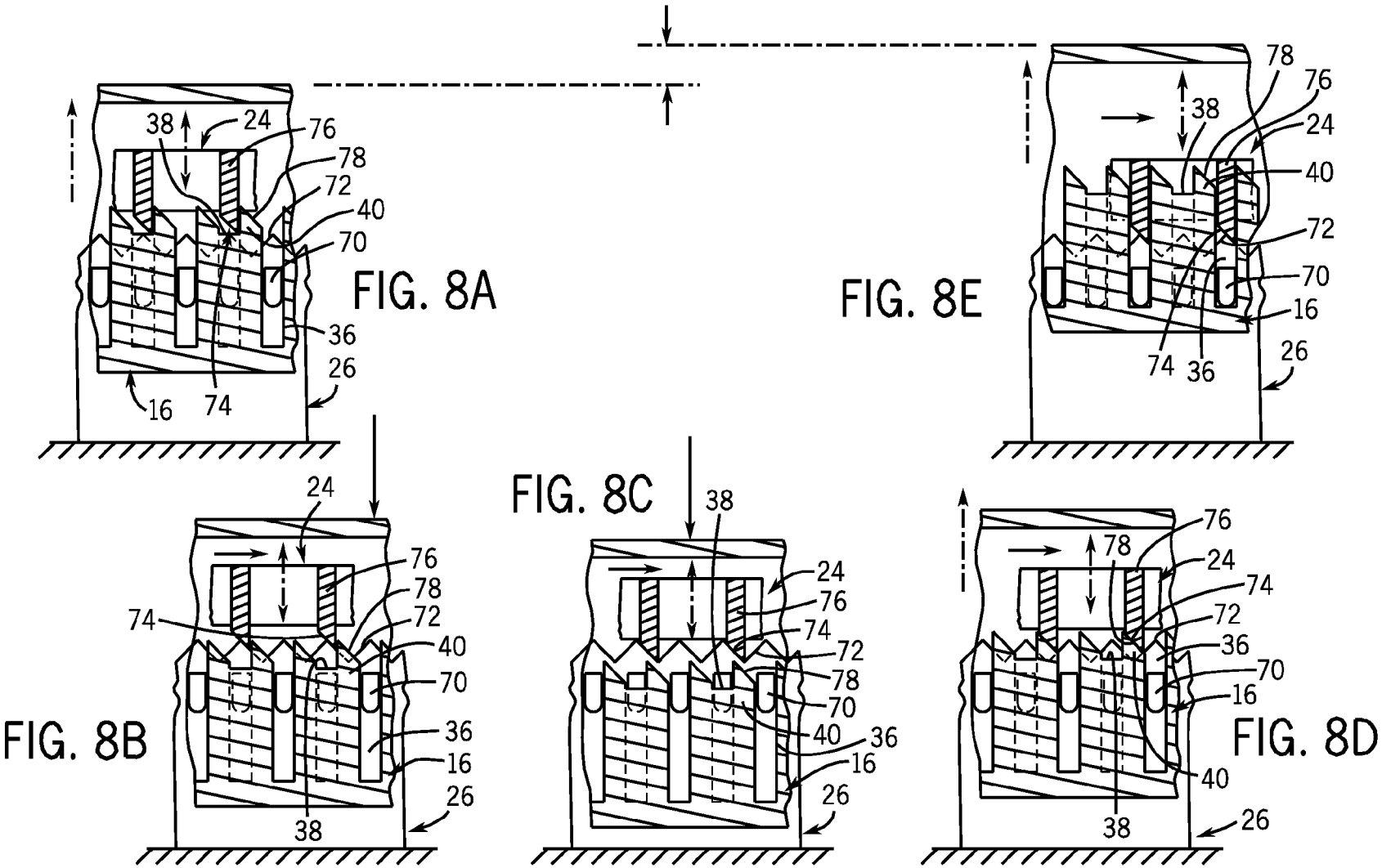
FIGS. 8A-8E show in linear fashion the internal arrangement and interaction of the actuating components within the mounting post as the drain assembly is moved from the closed position of FIG. 4 to the open position of FIG. 3.

When the assembly 10 is in the unseated position shown in FIG. 3, the apices of the radial projections 76 of the cam insert 24 are located within the recesses 36 of the mounting post 16 (see FIGS. 6 and 8E). The radial projections 70 are also disposed within the recesses 36 and engaged with the bottom ends thereof to prevent the mounting post 16 and stopper 12 from separating from the support stem 26 under the spring force. While prohibited from moving further in the upward direction, the alignment of the radial projections 76 of the cam insert 24 with the recesses 38 permit the stopper 12 and mounting post 16 to be pressed downward to reseat the seal 14. When the assembly 10 is in the seated position shown in FIG. 4, the apices of the cam surfaces 74 of the cam insert 24 abut the top of the stops 38 (see FIGS. 7 and 8A). Because the spring is compressed its force is sufficient to hold the cam insert 24 in this position, and thereby prevent the stopper 12 and the mounting post 16 from raising and unseating the seal 14.

Figures 4, 7:
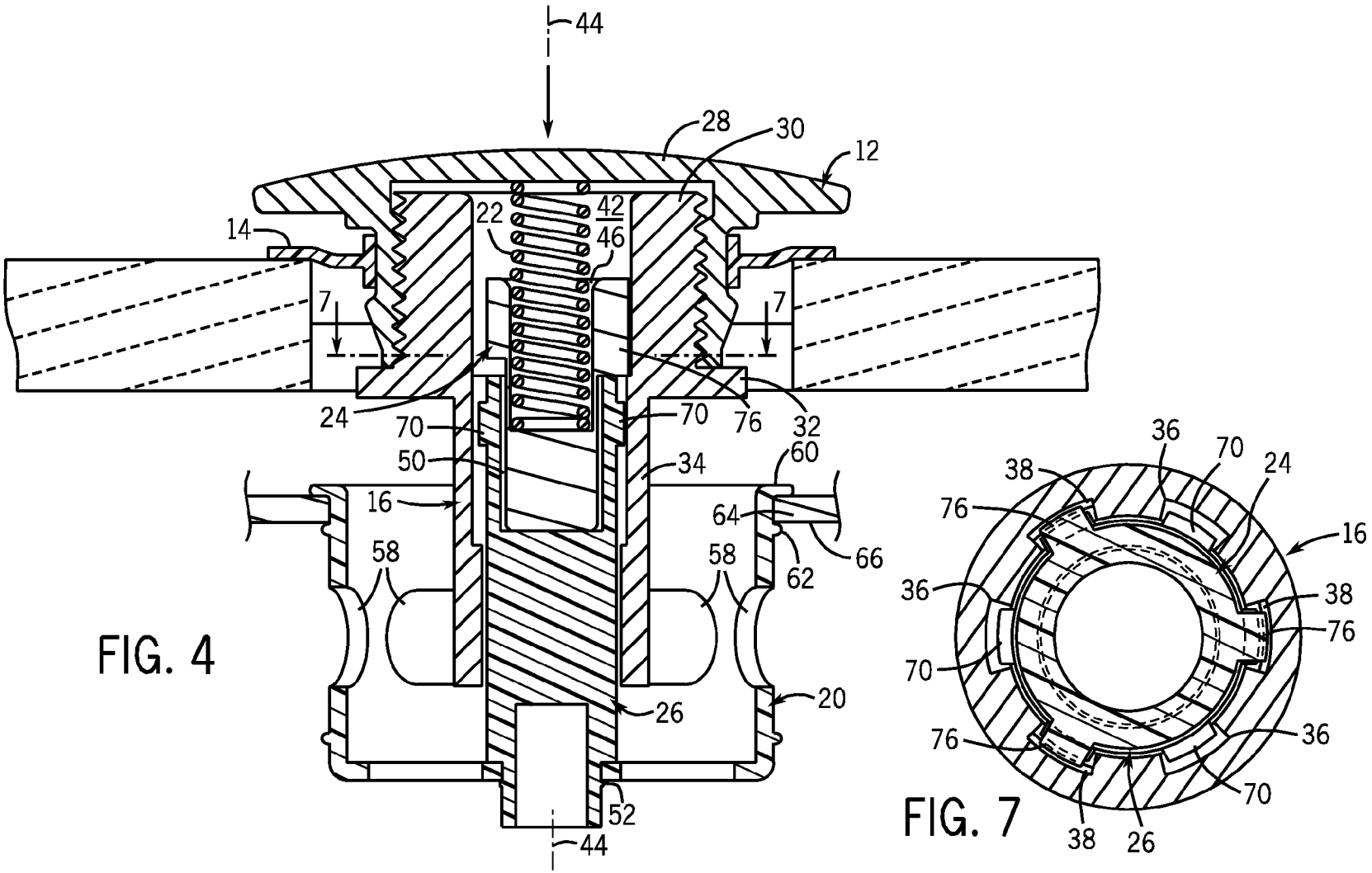
FIG. 4 is a view similar to FIG. 3, albeit in a closed position.
FIG. 7 is a sectional view taken along line 7-7 of FIG. 4 showing the relative orientation of the actuating assembly components when in the closed position of FIG. 4.

FIGS. 8A-8E illustrate the interaction of the actuating assembly 18 as the stopper 12 is moved from the seated position of FIG. 4 to the unseated position of FIG. 3. From the seat position shown in FIG. 8A, the user depresses the stopper 12 by pushing or stepping downwardly on the head 28. This causes the stopper 12 and mounting post 16 to move toward the catch basket 20, which compresses the spring 22 and increases the biasing force against the cam insert 24. As shown in FIG. 8B, when the mounting post is lowered sufficiently, the cam surfaces 74 of the radial projections 76 on the cam insert 24 will disengage the stops 28 and engage the cam surfaces 72 of the support stem 26. This causes the cam insert 24 to rotate about the axis 44 as the cam surfaces 74 of the cam insert 24 ride down along the ramps of the cam surfaces 72 of the support stem 26 until the bottom in the valleys, as shown in FIG. 8C. By releasing the stopper 12, the mounting post 16 begins to travel axially upward such that the cam surfaces 74 of the cam insert 24 disengage the cam surfaces 72 of the support stem 26 and reengage the cam surfaces 78 of the splines 40, as shown in FIG. 8D. This causes the cam insert 24 to further rotate about the axis 44 such that its radial projections 76 are aligned with the recesses 36, as shown in FIG. 8E. In this orientation, the radial projections 76 of the cam insert 24 are in registration with and slide into the associated recesses 36, thereby allowing the mounting post 16 and stopper 12 to be raised sufficiently to unseat the seal 14. To return the stopper 12 to the seated position of FIG. 3, again the head 28 is depressed downward to cause the cam insert 24 to move in the opposite direction, essentially going from FIG. 8E back through to FIG. 8A.

If an item happens to fall through the drain opening it can be caught in the catch basket 20. To retrieve the item, the entire assembly 10 is removed from the drain opening by pulling up on the stopper 12 to dislodge the catch basket 20 from the support structure 66, rotation or cocking of the assembly 10 may facilitate removal, although that should not be necessary in most cases. With the assembly 10 out from the drain opening, the catch basket 20 is readily available, and the contents can thus be removed, typically by hand or by dumping the items out. With the items removed, once simply places the assembly 10 back into the drain opening and reseats the catch basket 20 in engagement with the support structure 66.

Thus, the present invention thus provides an improved pop-up or push-button style drain control assembly having a clean aesthetic appearance without a sealing flange protruding above the basin, that is simple to install and operate, and that provides easy access to the contents of the catch basket without requiring disassembly.

While a specific embodiment has been shown, various modifications falling within the breadth and scope of the invention will be apparent to one skilled in the art. Thus, the following claims should be looked to in order to understand the full scope of the invention.

Industrial Applicability

The present invention provides a pop-up drain control assembly that is simple to install and operate, and provides ready access to the contents of its catch basket without the need for disassembly.

What is claimed is:

1. A pop-up drain control assembly for controlling flow through a drain opening in one of a sink or a basin, comprising:

a stopper having an annular seal;

a post mounting the stopper at one end thereof and defining an annular cavity extending along an axis passing through the drain opening;

a spring-biased actuating assembly disposed within the annular cavity for moving the stopper along the axis and directly engaging the seal with the sink or the basin about the drain opening; and a catch basket mounted to the actuating mechanism for relative movement of the stopper, the catch basket defining a bottom and a side wall, the side wall having one or more openings sized smaller than the drain opening, the catch basket being sized and configured to removably mount the drain control assembly within the drain opening.

2. A pop-up drain control assembly for controlling flow through a drain opening in one of a sink or a basin, comprising:

a stopper having an annular seal;

a post mounting the stopper at one end thereof and defining an annular cavity extending along an axis passing through the drain opening;

a spring-biased actuating assembly disposed within the annular cavity for moving the stopper along the axis and directly engaging the seal with the sink or the basin about the drain opening; and a catch basket mounted to the actuating mechanism for relative movement of the stopper, the catch basket defining a bottom and a side wall, at least one of the bottom and side wall having one or more openings sized smaller than the drain opening, the catch basket being sized and configured to removably mount the drain control assembly within the drain opening;

wherein the catch basket has an opening in the bottom receiving a member of the actuating assembly in a snap fit.

3. The assembly of claim 2, wherein the actuating assembly includes:

a spring extending essentially along the axis;

a cam insert movably capturing the spring between the stopper, the cam insert having a radial projection and a cam surface; and a support stem linked to the catch basket at one end and having a cam surface at an opposite end for engagement with the cam surface of the cam insert, the support stem also having a radial projection.

4. The assembly of claim 3, wherein the post has a splined internal surface defining a stop and a radial recess opening to the annular cavity and extending along the internal surface in the axial direction, the stop extending radially inward of the recess and the recess being sized to receive the radial projections of the cam insert and the support stem and the stop being sized to interfere with the radial projection of the cam insert.

5. The assembly of claim 4 claim, wherein the post defines a plurality of recesses and stops in alternating arrangement about the internal surface and wherein the cam insert and the support stem each have a plurality of radial projections.

6. The assembly of claim 5, wherein each of the cam insert and the support stem have a plurality of cam surfaces.

7. The assembly of claim 6, wherein the cam surfaces of the cam insert are defined by the radial projections.

8. The assembly of claim 7, wherein the post defines a plurality of splines each disposed between a recess and a stop.

9. The assembly of claim 8, where each of the splines defines a cam surface.

10. The assembly of claim 9, wherein the radial projections of the cam insert are sized to engage the cam surfaces of the support stem as well as the stops and the cam surfaces of the mounting post as the stopper is moved to seat and unseat the seal.

11. The assembly of claim 10, wherein in a first position in which the seal engages the sink or the basin, the radial projections of the cam insert and the support stem are received in the recesses of the mounting post.

12. A pop-up drain control assembly for controlling flow through a drain opening in a sink or a basin, comprising:

a stopper having an annular seal;

a post mounting the stopper at one end thereof and defining an annular cavity extending along an axis passing through the drain opening, the post having an internal surface defining an axially extending spline with a cammed upper end, a stop to one side of the spline, and a radial recess to the other side opening to the annular cavity, the stop extending radially inward of the recess;

a spring-biased actuating assembly disposed within the annular cavity for moving the stopper along the axis and directly engaging the seal with the sink or the basin about the drain opening, the actuating assembly including:

a spring extending essentially along the axis;

a cam insert movably capturing the spring between the stopper, the cam insert having a radial projection defining a cam surface; and a support stem linked to a catch basket at one end and having a cam surface at an opposite end for engagement with the cam surface of the cam insert, the support stem also having a radial projection; and the catch basket mounted to the support stem, the catch basket defining a bottom and a side wall, at least one of the bottom and side wall having one or more openings sized smaller than the drain opening, the catch basket being sized and configured to removably mount the drain control assembly within the drain opening.

13. A pop-up drain control assembly for controlling flow through a drain opening, comprising:

a stopper having a seal;

a spring-biased actuating assembly for moving the stopper along an axis passing through the drain opening for sealing the drain opening with the seal; and a catch basket mounted to the actuating mechanism;

wherein the catch basket is configured to couple to and readily disengage from a support member, the catch basket being configured to disengage from the support member by applying an upward force to the stopper.

14. The pop-up drain control assembly of claim 13, wherein the support member is located beneath the drain opening.

15. The pop-up drain control assembly of claim 14, wherein the support member is spaced apart from a structure defining the drain opening in a region proximate the drain opening.

16. The pop-up drain control assembly of claim 13, wherein the catch basket is configured to couple to the support member with one of a threaded, snap-fit, or friction fit connection.

17. The pop-up drain control assembly of claim 13, wherein the catch basket includes a radially extending flange configured to seat against the support member.

18. The pop-up drain control assembly of claim 17, wherein the catch basket includes a circumferential projection, the radially extending flange and circumferential projection defining a groove for coupling to the support member.

19. The pop-up drain control assembly of claim 18, wherein the circumferential projection extends radially less than the radially extending flange.

20. The pop-up drain control assembly of claim 16, wherein the catch basket is configured to couple to the support member with one of a snap-fit or friction fit connection.

* * * * *